US008344978B2

(12) United States Patent
Kim et al.

(10) Patent No.: US 8,344,978 B2
(45) Date of Patent: Jan. 1, 2013

(54) DIGITAL-TO-ANALOG CONVERTER FOR DISPLAY DEVICE

(75) Inventors: Sang Suk Kim, Seoul (KR); Jin Ho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 1182 days.

(21) Appl. No.: 12/222,379

(22) Filed: Aug. 7, 2008

(65) Prior Publication Data

US 2009/0046083 A1 Feb. 19, 2009

(30) Foreign Application Priority Data

Aug. 8, 2007 (KR) ..... 10-2007-0079594

(51) Int. Cl.
*G09G 3/36* (2006.01)
*H03M 1/66* (2006.01)

(52) U.S. Cl. ..... 345/89; 341/144

(58) Field of Classification Search ..... 345/204, 345/609, 87, 88, 89; 341/126–172
See application file for complete search history.

(56) References Cited

U.S. PATENT DOCUMENTS 4,978,959 A * 12/1990 Chong et al. ..... 341/161
5,396,245 A * 3/1995 Rempfer ..... 341/145
5,859,606 A * 1/1999 Schrader et al. ..... 341/144
6,246,351 B1 * 6/2001 Yilmaz ..... 341/145
6,373,419 B1 * 4/2002 Nakao ..... 341/154
6,469,647 B1 * 10/2002 Kinugasa et al. ..... 341/145
6,617,989 B2 * 9/2003 Deak ..... 341/144
6,937,178 B1 * 8/2005 Rempfer et al. ..... 341/154
7,551,111 B2 * 6/2009 Shimatani ..... 341/144
7,576,674 B2 * 8/2009 Tsuchi ..... 341/144
7,671,831 B2 * 3/2010 Chang et al. ..... 345/100
7,994,956 B2 * 8/2011 Tsuchi ..... 341/144
2005/0259058 A1 * 11/2005 Yamaguchi et al. ..... 345/87
2009/0033589 A1 * 2/2009 Ozaki ..... 345/55
2010/0052966 A1 * 3/2010 Tsuchi ..... 341/154

* cited by examiner

*Primary Examiner* — William Boddie
*Assistant Examiner* — Alecia D English
(74) *Attorney, Agent, or Firm* — McKenna Long & Aldridge LLP

(57) ABSTRACT

A digital-to-analog converter (DAC) for a display device is provided. The DAC includes an amplifier and a current decoder. The amplifier receives a gradation voltage with respect to upper bits in data of k bits through a non-inverting input terminal, and varies the input gradation voltage according to a voltage applied to an inverting input terminal. The current decoder allows a predetermined constant current to flow therethrough according to input data of lower bits, which do not include the upper bits, to thereby vary the voltage applied to the inverting input terminal. The current decoder further adjusts the gradation voltage outputted by the amplifier according to the varied voltage.

20 Claims, 7 Drawing Sheets

DIGITAL-TO-ANALOG CONVERTER FOR DISPLAY DEVICE

CROSS-REFERENCE TO RELATED APPLICATION

This application claims priority from Korean Patent Application No. 10-2007-0079594 filed on Aug. 8, 2007 in the Korean Intellectual Property Office, the disclosure of which is incorporated herein by reference in its entirety.

BACKGROUND OF THE INVENTION

1. Field of the Invention

The present invention relates to a digital-to-analog converter (DAC), and more particularly, to a DAC for a display device which generates a gradation voltage according to input data.

2. Description of the Related Art

A display device, such as a liquid crystal display (LCP), a plasma display panel (PDP), an organic light-emitting diode (OLED) display, etc., uses a DAC to decode digital data that are inputted from an external source so as to convert the data into an analog gradation voltage. The gradation voltage is then used to drive each pixel R,G,B and thereby display a desired image.

For example, each pixel R, G, B of an LCD exhibits nonlinear light transmission characteristics. To achieve linearity with respect to such nonlinear light transmission, gamma correction is performed in a DAC of a source driver which drives the pixels. Gamma correction is effective in obtaining a linear relation between a voltage applied to the pixels and light transmission.

To operate a liquid crystal panel of the LCD, a voltage is applied to liquid crystals such that light emitted from a backlight is adjusted and a desired image is displayed. Since the light transmission characteristics of each pixel are different, the LCD must adjust the light transmission of each pixel (R,G,B) differently in order to accurately display the desired image on the liquid crystal panel.

However, even with such differences in light transmission for each pixel R,G,B, existing approaches still are not able to perform control such that the light transmission of each pixel is precisely transmitted to each pixel due to the fact that with such existing approaches, the gradation scale value of each pixel is identically designed in the DAC on the basis of a specific pixel. As a result, the color tone appearing on the liquid crystal panel is unnatural. That is, the color tone of objects appearing on the liquid crystal panel is different from the actual color tone.

Hence, to overcome this drawback, there is a need for a linear DAC that allows a high resolution to be obtained by the display device to which the DAC is applied.

FIG. 1 is a schematic circuit block diagram of a conventional DAC 10. The DAC 10 of FIG. 1 includes a gradation voltage generator 11, a decoder 13, a switch controller 15, and a buffer 17.

The gradation voltage generator 11 includes a plurality of resistors connected in series to thereby generate dissimilar gradation voltages via the different voltage drops across the resistors. The decoder 13 receives signals of upper n bits in a parallel input signal of k bits, and selects switches corresponding to the input n bits so as to output a gradation voltage corresponding to the gradation voltage generator 11 through a first reference line ($V_{REFL}$). During this operation, the decoder 13 also selects a gradation voltage adjacent to the selected gradation voltage and outputs the same through a second reference line ($V_{REFH}$).

The switch controller 15 receives signals a of lower m bits in the parallel input signal of k bits, and according to input data of the m bits, controls a plurality of internal switches (not shown) such that the first and second reference lines ($V_{REFL}$, $V_{REFH}$) are connected to a plurality ($2^m$) of output lines, and the signals inputted through the first and second reference lines ($V_{REFL}$, $V_{REFH}$) are multiplexed and outputted through each of the $2^m$ output lines. The buffer 17 receives the signals outputted by the switch controller 15 and performs interpolation to effect buffering, after which a resulting gradation voltage $V_{OUT}$ is outputted through an output terminal of the buffer 17.

In the conventional DAC 10 configured and operating as in the above, in order to realize a high grayscale, the gradation voltage generator 11 must utilize $2^n$ resistors, where n is the number of bits of digital data inputted to the decoder 13, and the switches of the decoder 13 are needed to select the generated gradation voltages. Accordingly, if it is desired to achieve an improvement in resolution of n bits, the circuit area is increased exponentially ($2^n$), and at the same time, an operating reference voltage for expressing grayscale must be extremely large and precise.

To overcome these problems, a conventional DAC has been proposed that utilizes two decoders, each associated with an array of resistors. An example of such conventional DAC is shown in FIG. 2.

FIG. 2 is a schematic circuit block diagram of another conventional DAC 50. The DAC 50 of FIG. 2 includes a first gradation voltage generator 51, a first decoder 52, a pair of buffers 53, 54, a second gradation voltage generator 55, a second decoder 56, a switch controller 57, and another buffer 58.

The first gradation voltage generator 51 includes a plurality of resistors connected in series to generate dissimilar gradation voltages via the different voltage drops across the resistors. The first decoder 52 receives upper n bits in a parallel input signal of k bits, and selects switches corresponding to the input n bits to output a corresponding gradation voltage of the first gradation voltage generator 51 through a first reference line $V'_{REFL}$. During this operation, the first decoder 52 also selects a gradation voltage adjacent to the selected gradation voltage and outputs the same through a second reference line $V'_{REFH}$.

The buffers 53, 54 perform buffering of the signals outputted through the first and second reference lines $V'_{REFL}$, $V'_{REFH}$ to stabilize the signals, after which the stabilized signals are outputted to the second gradation voltage generator 55.

The second decoder 56 receives lower m bits in the parallel input signal of k bits, selects switches corresponding to the input m bits, and outputs a corresponding gradation voltage of the second gradation voltage generator 55 through each of third and fourth reference lines $V''_{REFL}$, $V''_{REFH}$.

The switch controller 57 receives signals of lowermost j bits in the parallel input signal of k bits, and according to the input j bit data, controls a plurality of internal switches (not shown) such that the third and fourth reference lines $V''_{REFL}$, $V''_{REFH}$ are connected to a plurality ($2^j$) of output lines, and the signals inputted through the third and fourth reference lines $V''_{REFL}$, $V''_{REFH}$ are multiplexed and outputted through the $2^j$ output lines. The buffer 58 receives the signals outputted by the switch controller 15 and performs interpolation to effect buffering, after which a predetermined gradation voltage $V_{OUT}$ is outputted through an output terminal of the buffer 58.

In FIG. 2, each of the first and second decoders 52, 56 is associated with an array of resistors for dividing the voltage applied thereto, and includes switches for outputting analog voltages corresponding to the digital data in the voltages outputted by the set of resistors.

Further, the first decoder 52 and the second decoder 56 are interconnected via the buffers 53, 54. This ensures that the voltage levels divided by the first decoder 52 are not influenced by the array of resistors of the second gradation voltage generator 55.

That is, in FIG. 2, the analog values outputted through the n-bit and m-bit first and second decoders 52, 56 are inputted to the switch controller 57, and following the interpolation operation of the j-bit buffer 58, the final analog gradation voltage $V_{OUT}$ is outputted through the output terminal of the buffer 58.

This conventional DAC 50 also suffers from an increase in circuit area due to the fact that two buffers 53, 54 are used therein.

Moreover, due to an offset voltage of the buffers 53, 54, the degree of precision of this conventional DAC 50 is limited by at least an amount corresponding to the offset voltage of the buffers 53, 54.

Additionally, the greater the number of bits of the data that needs to be processed, the greater the number of the resistors of the gradation voltage generators 51, 55 and the number of the decoders 52, 56. This results in an exponential increase in the size of the DAC 50. Typically, an increase in the number of bits by n results in a $2^n$ increase in the size of the DACs 10, 50 of FIGS. 1 and 2.

Since the decoders 52, 56 of FIG. 2 divide the signal of k bits to process either n bits or m bits, they are smaller in size than the decoder 13 of FIG. 1. However, due to the use of the additional resistors for voltage division and an additional buffer for error reduction in the output voltage in the DAC 50 of FIG. 2, the DAC 50 of FIG. 2 remains large.

SUMMARY OF THE INVENTION

Accordingly, the present invention is directed to a digital-to-analog converter (DAC) for a display device that substantially obviates one or more problems due to limitations and disadvantages of the related art.

Aspects of the present invention provide a DAC for a display device, in which data inputted into the DAC is separated into bits and processed to express grayscale by a combination of a voltage division method and a current adjusting method, such that an exponential increase in size in accordance with an increase in the number of bits is prevented and a high resolution for the display device is ensured.

Aspects of the present invention also provide a DAC for a display device, in which a gradation voltage outputted by the DAC expresses a grayscale through a current adjusting method, such that the DAC is linearly designed. Therefore, the gradation voltage of each pixel is optimally adjusted according to the light transmission characteristics of each pixel.

Additional advantages, aspects, and features of the invention will be set forth in part in the description which follows and in part will become apparent to those having ordinary skill in the art upon examination of the following or may be learned from practice of the invention.

According to an aspect of the present invention, there is provided a digital-to-analog converter (DAC) for a display device, the DAC including: an amplifier which receives a gradation voltage with respect to upper bits in data of k bits through a non-inverting input terminal, and which varies the input gradation voltage according to a voltage applied to an inverting input terminal; and a current decoder which allows a predetermined constant current to flow therethrough according to input data of lower bits, which do not include the upper bits, to thereby vary the voltage applied to the inverting input terminal, and which adjusts the gradation voltage outputted by the amplifier according to the varied voltage.

The current decoder adjusts the gradation voltage outputted by the amplifier in accordance with the application of a predetermined current to a ground terminal, the level of the predetermined current being determined on the basis of the input data of the lower bits.

The current decoder includes a feedback resistor disposed on a feedback current path from an output terminal of the amplifier to the inverting input terminal of the amplifier; and a constant current unit connected in series between one terminal of the feedback resistor and a ground terminal, and that undergoes switching according to the input data of the lower bits to thereby flow a predetermined fixed current to the ground terminal.

The constant current unit includes a number of constant current means corresponding to the number of the lower bits, and wherein if there is a plurality of the constant current means, the constant current means are mounted in parallel between the one terminal of the feedback resistor and the ground terminal.

Each of the constant current means includes a switching means and a constant current source. The switching means is connected in series on a current path between the one terminal of the feedback resistor and the constant current source and undergoing switching while receiving as input the data of a particular bit among the lower bits, and the constant current source is connected in series between one terminal of the switching means and the ground terminal and applying a fixed current outputted by the amplifier to the ground terminal according to the switching state of the switching means.

The current decoder further includes a buffer switch connected in parallel to the feedback resistor, the buffer switch being turned on when the data of the lower bits are all "0."

The current decoder adjusts the gradation voltage outputted by the amplifier in accordance with the application of a predetermined current to an output terminal of the amplifier, the level of the predetermined current being determined on the basis of the input data of the lower bits.

The current decoder includes a feedback resistor disposed on a feedback current path from the output terminal of the amplifier to the inverting input terminal of the amplifier; and a constant current unit connected in series between one terminal of the feedback resistor and a source terminal, and that undergoes switching according to the input data of the lower bits to thereby apply a predetermined fixed current to the output terminal of the amplifier.

The constant current unit includes a number of constant current means corresponding to the number of the lower bits, and if there is a plurality of the constant current means, the constant current means are mounted in parallel between the one terminal of the feedback resistor and the source terminal.

Each of the constant current means includes a switching means and a constant current source. The switching means is connected in series on a current path between the one terminal of the feedback resistor and the constant current source and undergoing switching while receiving as input the data of a particular bit among the lower bits. The constant current source is connected in series between one terminal of the switching means and the source terminal and applying a source voltage according to the switching state of the switching means.

According to another aspect of the present invention, there is provided a DAC for a display device, the DAC including: a decoder which receives data of n bits in input data of k bits, the decoder outputting a plurality of gradation voltages corresponding to the n bits to each of a plurality of reference lines; a switch controller which controls a plurality of internal switches according to input data of m bits in the input data of k bits to multiplex the gradation voltages inputted through the plurality of reference lines; an amplifier which receives through a non-inverting input terminal thereof a plurality of gradation voltages outputted by the switch controller, and after performing interpolation, varies a resulting voltage according to a voltage applied to an inverting input terminal of the amplifier to thereby obtain and output a gradation voltage; and a current decoder which allows a predetermined constant current to flow therethrough according to input data of lowermost j bits in the input data of k bits to thereby vary the voltage applied to the inverting input terminal, and which adjusts the gradation voltage outputted by the amplifier according to the varied voltage.

The current decoder adjusts the gradation voltage outputted by the amplifier in accordance with the application of a predetermined current to a ground terminal, the level of the predetermined current being determined on the basis of the input data of the lowermost j bits. Further, the current decoder includes a feedback resistor disposed on a feedback current path from an output terminal of the amplifier to the inverting input terminal of the amplifier; and a constant current unit connected in series between one terminal of the feedback resistor and a ground terminal, and that undergoes switching according to the input data of the lowermost j bits to thereby flow a predetermined fixed current to the ground terminal.

The current decoder adjusts the gradation voltage outputted by the amplifier in accordance with the application of a predetermined current to an output terminal of the amplifier, the level of the predetermined current being determined on the basis of the input data of the lower bits. The current decoder includes a feedback resistor disposed on a feedback current path from the output terminal of the amplifier to the inverting input terminal of the amplifier; and a constant current unit connected in series between one terminal of the feedback resistor and a source terminal, and that undergoes switching according to the input data of the lowermost j bits to thereby apply a predetermined fixed current to the output terminal of the amplifier.

BRIEF DESCRIPTION OF THE DRAWINGS

The accompanying drawings, which are included to provide a further understanding of the invention and are incorporated in and constitute a part of this application, illustrate exemplary embodiment(s) of the invention and together with the description serve to explain the principle of the invention. In the drawings.

DETAILED DESCRIPTION OF THE EXEMPLARY EMBODIMENTS

Figure 1:
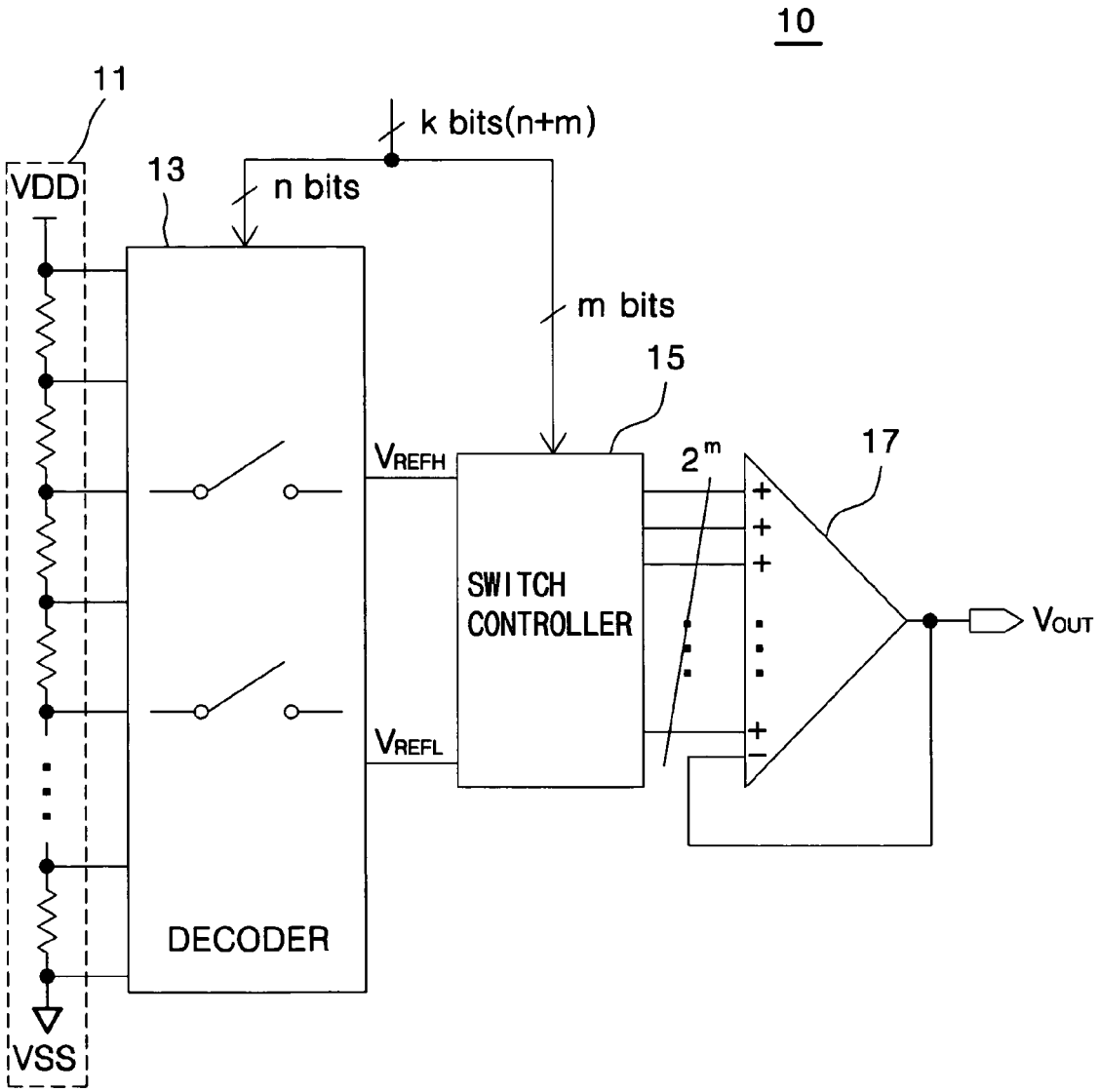
FIG. 1 is a schematic circuit block diagram of a conventional digital-to-analog converter.
Figure 2:
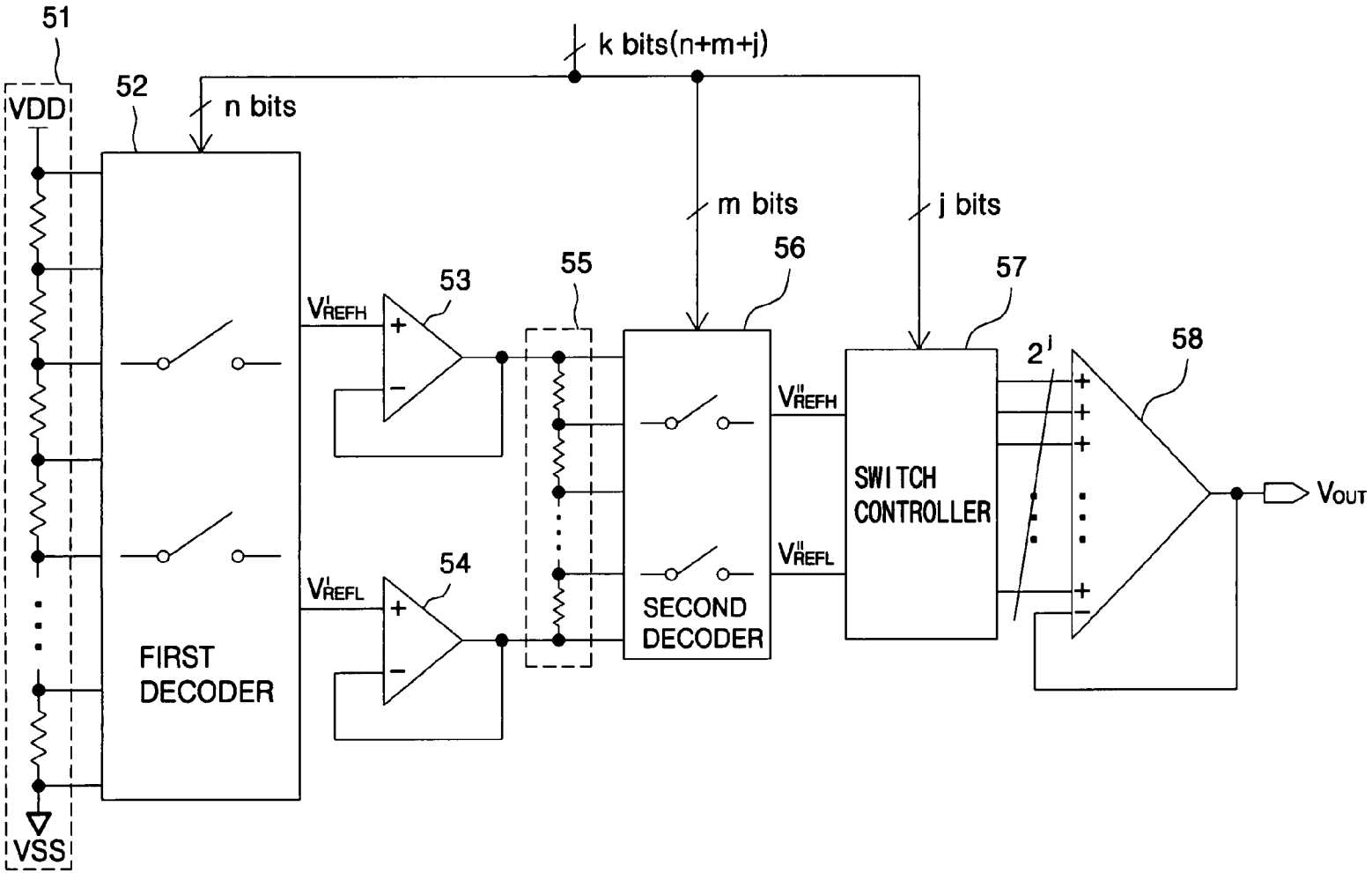
FIG. 2 is a schematic circuit block diagram of another conventional digital-to-analog converter.

Reference will now be made in detail to the exemplary embodiments of the present invention, examples of which are illustrated in the accompanying drawings. The invention may, however, be embodied in many different forms and should not be construed as being limited to the embodiments set forth herein. Rather, these embodiments are provided so that this disclosure will be thorough and complete, and will fully convey the concept of the invention to those skilled in the art. Wherever possible, the same reference numerals will be used throughout the drawings to refer to the same or like parts.

Figure 3:
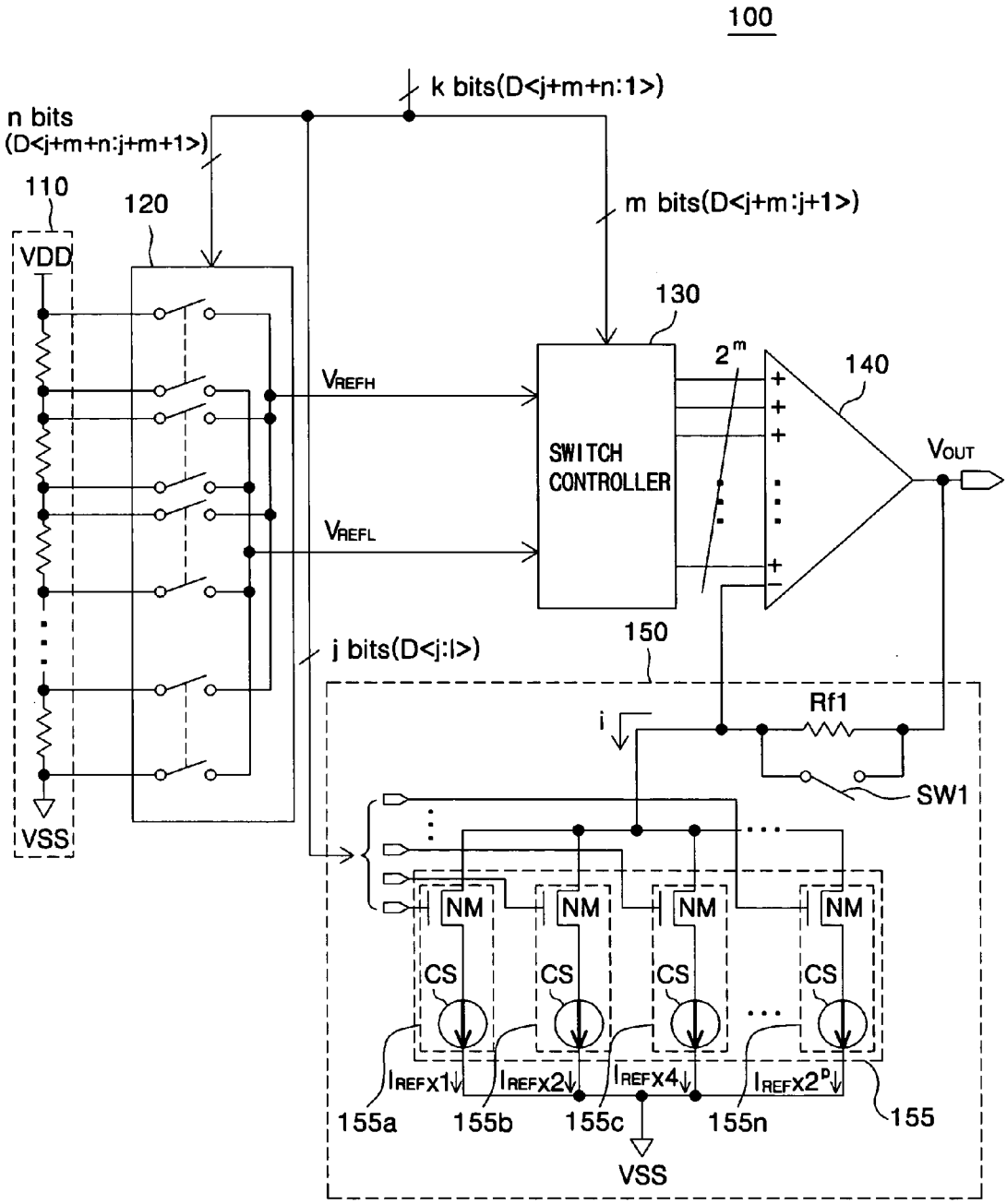
FIG. 3 is a schematic circuit block diagram of a digital-to-analog converter for a display device according to an embodiment of the present invention.

FIG. 3 is a schematic circuit block diagram of a digital-to-analog converter (DAC) 100 for a display device according to an embodiment of the present invention. The DAC 100 includes a gradation voltage generator 110, a decoder 120, a switch controller 130, an amplifier 140, and a current decoder 150.

The gradation voltage generator 110 includes a plurality of resistors connected in series to thereby generate dissimilar voltages via the different voltage drops across the resistors.

The decoder 120 receives input of data (D<j+m+n:j+m+1>) with respect to upper n bits in input data (D<j+m+n:1>) of k bits (n+m+j bits), and selects a pair of switches corresponding to the input n bits to thereby output corresponding gradation voltages of the gradation voltage generator 110 via first and second reference lines $V_{REFL}$, $V_{REFH}$.

The switch controller 130 controls a plurality of internal switches (not shown) according to input data (D<j+m:j+1>) of lower m bits in the input data of k bits such that the first and second reference lines $V_{REFL}$, $V_{REFH}$ are connected to a plurality ($2^m$) of output lines, and the signals inputted through the first and second reference lines $V_{REFL}$, $V_{REFH}$ are multiplexed and outputted through the $2^m$ output lines.

The amplifier 140 receives a plurality of input signals outputted by the switch controller 130 through non-inverting input terminals (+), and after performing interpolation, outputs a resulting voltage through an output terminal thereof to a corresponding pixel (R, G, or B) of a liquid crystal panel. Further, the amplifier 140 varies the gradation voltages inputted through the non-inverting input terminals (+) according to a voltage applied to an inverting input terminal (−) thereof.

The current decoder 150 applies a predetermined constant current to a ground terminal VSS according to input data (D<j:1>) of lowermost j bits in the input data of k bits to vary the voltage applied to the inverting input terminal (−) of the amplifier 140 and adjust the gradation voltage outputted by the amplifier 140.

The current decoder 150 includes a feedback resistor Rf1, a buffer switch SW1, and a constant current unit 155.

The feedback resistor Rf1 is disposed on a feedback current path from the output terminal of the amplifier 140 to the inverting input terminal (−) of the amplifier 140. The buffer switch SW1 is connected in parallel with the feedback resistor Rf1.

The constant current unit 155 is connected in series between one terminal of the feedback resistor Rf1 and the ground terminal VSS, and undergoes switching according to input data of the lowermost bits such that a predetermined current flows to the ground terminal VSS.

The constant current unit 155 preferably includes a number of constant current means that is equal to the number of bits of the lowermost bits. For example, the constant current unit 155 includes one constant current means 155*a* when there is one lowermost bit, two constant current means 155*a*, 155*b* when there are two lowermost bits, and three constant current means 155*a*, 155*b*, and 155*c* when there are three lowermost bits.

In the case where the constant current unit 155 includes a plurality of constant current means 155*a*~155*n*, the constant current means 155*a*~155*n* are connected in parallel between the one terminal of the feedback resistor Rf1 and the ground terminal VSS, and operate depending on the input of different bit positions of data. As a result, the amount of current applied to the ground terminal VSS by each of the constant current means 155*a*~155*n* is different.

Moreover, each of the constant current means 155*a*~155*n* includes a switching means NM and a constant current source CS. The switching means NM of each of the constant current means 155*a*~155*n* is connected in series to a current path between the one terminal of the feedback resistor Rf1 and the ground terminal VSS, and undergoes switching while receiving as input a particular bit among the lowermost bits. The constant current source CS of each of the constant current means 155*a*~155*n* is connected in series between one terminal of the corresponding switching means NM and the ground terminal VSS, and applies the predetermined current outputted by the amplifier 140 to the ground terminal VSS according to the switching state of the corresponding switching means NM.

The switching means NM of each of the constant current means 155*a*~155*n* undergoes switching while receiving as input a particular bit among the lowermost j bits, and is an NMOS transistor in this embodiment.

In the case where the constant current unit 155 includes a plurality of constant current means 155*a*~155*n*, the constant current source CS of each of the constant current means 155*a*~155*n* applies a current amount to the ground terminal VSS corresponding to $I_{REF}$ (reference current) times 2 to the power of the binary number bit number of the input data corresponding to the particular constant current means. That is, each of the constant current means 155*a*~155*n* applies to the ground terminal VSS a current amount of $I_{REF} \times 2^p$ (where p is the binary number bit number of the input data corresponding to the particular constant current means and which is used as the exponential value applied to the base 2).

In the above, the buffer switch SW1 that is connected in parallel with the feedback resistor Rf1 is turned on when the values of the lowermost j bits are all "0." In this state, the amplifier 140 applies all of the voltage $V_{OUT}$ of the output terminal of the amplifier 140 to the inverting input terminal (−) without any reduction in the output voltage $V_{OUT}$, such that the amplifier 140 is able to sufficiently effect amplification.

In the DAC 100 configured and operating as in the above, the input data formed of k bits are divided into upper bits (n bits), lower bits (m bits), and lowermost bits (j bits), and the upper bits (n bits), lower bits (m bits), and lowermost bits (j bits) are converted into analog signals respectively through multiple stages of serially connected analog converting means 120, 130, 150. The upper bits (n bits) and the lower bits (m bits) are converted into analog signals through a method of voltage division, and the lowermost bits (j bits) are converted into an analog signal through a method of current control to thereby express gradation voltages of pixels.

In particular, the input data of k bits are divided into upper n bits, lower m bits, and lowermost j bits, and data corresponding to each of the upper n bits, lower m bits, and lowermost j bits are inputted respectively to the decoder 120, the switch controller 130, and the current decoder 150. As a result, the size of the DAC 100 is reduced and a high resolution is achieved.

In the embodiment of the present invention, although a description is provided by which data corresponding to the upper n bits, lower m bits, and lowermost j bits are inputted respectively to the decoder 120, the switch controller 130, and the current decoder 150, alternatively, the input data of k bits may be divided into upper n bits and lower j bits, and data corresponding to each of the upper n bits and lower j bits may be inputted to the decoder 120 and the current decoder 150, respectively.

In the DAC 100 of this embodiment structured and operating as described above, if data of the upper n bits in the input data of k bits is inputted to the decoder 120, the decoder 120 selects switches corresponding to the input n bits such that the corresponding gradation voltage of the gradation voltage generator 110 is outputted through the first reference line $V_{REFL}$. During this operation, the decoder 120 also selects a gradation voltage adjacent ("adjacent gradation voltage") to the selected gradation voltage for an outputted through the second reference line $V_{REFH}$.

Selection of the corresponding gradation voltage and the gradation voltage adjacent thereto is performed differently depending on the grayscale rendering method of the display device. That is, in the case where the display device utilizes a positive grayscale method, voltages at the lower terminals of specific resistors are outputted through the first reference line $V_{REFL}$ as the gradation voltage corresponding to the input data, and the voltages at the upper terminals of the resistors are used as the adjacent gradation voltage and are outputted through the second reference line $V_{REFH}$.

Where the display device utilizes a negative grayscale method, the voltages at the upper terminals of the resistors of the gradation voltage generator 110 are outputted through the second reference line $V_{REFH}$ as the gradation voltage corresponding to the input data, and the voltages at the lower terminals of the resistors are used as the adjacent gradation voltage and are outputted through the first reference line $V_{REFL}$.

The switch controller 130 receives the lower m bits in the input data of k bits, and controls its internal switches (not shown) according to the data of the m bits to thereby multiplex the lower limit voltage and upper limit voltage input through the first reference line $V_{REFL}$ and the second reference line $V_{REFH}$ and output the result through a plurality of output lines ($2^m$ output lines).

Figure 4A:
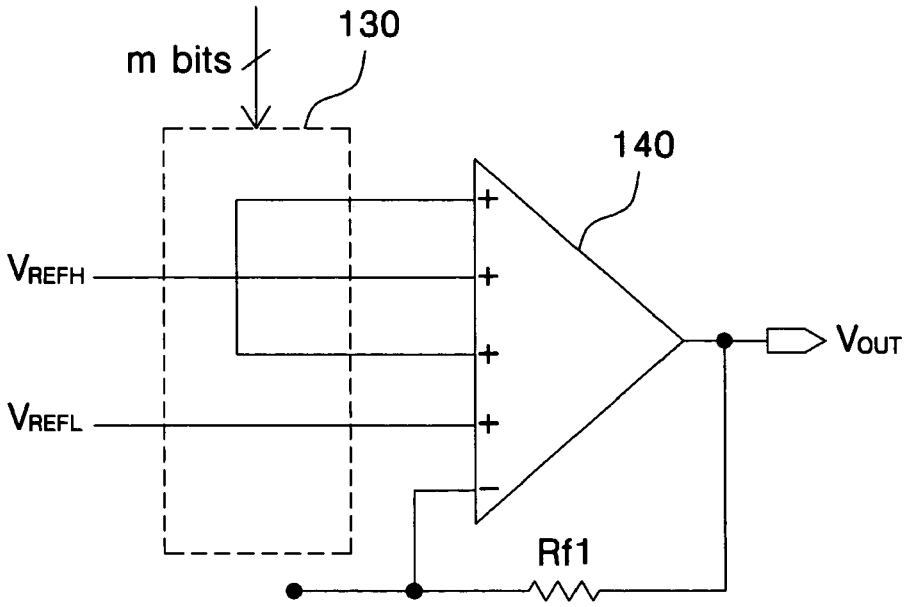
FIGS. 4A and 4B are schematic diagrams illustrating examples of multiplexing of input and output lines of a switch controller of the present invention.
Figure 4B:
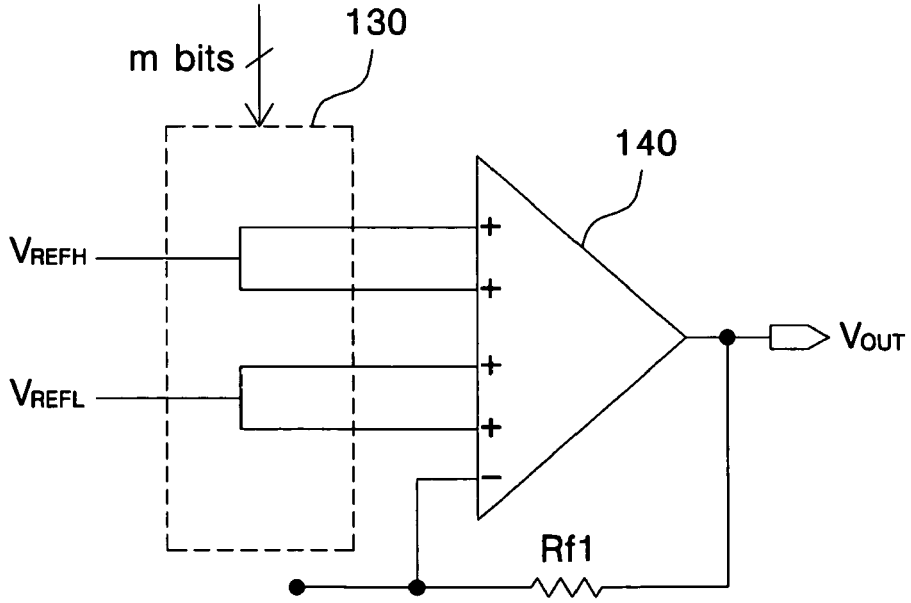

FIGS. 4A and 4B illustrate examples in which the lower limit voltage and the upper limit voltage inputted through the first reference line $V_{REFL}$ and the second reference line $V_{REFH}$ are multiplexed through a plurality of output lines according to the data inputted to the switch controller 130.

For example, if it assumed that the data inputted to the switch controller 130 has two bits and the value of both bits is 1, as shown in FIG. 4A, the internal switches (not shown) are controlled such that the one output line is connected to the lower limit voltage outputted from the first reference line $V_{REFL}$, and three output lines are connected to the upper limit voltage outputted from the second referenced line $V_{REFH}$.

Through such control of the internal switches (not shown), the switch controller 130 obtains an output as shown in Equation 1 below.

$$\frac{L1}{2^n}V_{REFL}+\frac{L2}{2^n}V_{REFH}$$ [Equation 1]

where, $n$ is the number of bits of input data, $L1$ is the number of output lines coupled to $V_{REFL}$, $L2$ is the number of output lines coupled to $V_{REFH}$.

As an example, if the lower limit voltage outputted through the first reference line $V_{REFL}$ is 2V and the upper limit voltage outputted through the second reference line $V_{REFH}$ is 3V, the output of the switch controller 130 becomes 2.75V, as evident from Equation 1.

With reference to FIG. 4B, if it is assumed that the data inputted to the switch controller 130 has two bits and the values of the bits are 1 and 0, the internal switches (not shown) are controlled such that two output lines are connected to the lower limit voltage outputted by the first reference line $V_{REFL}$, and two output lines are connected to the upper limit voltage outputted by the second referenced line $V_{REFH}$.

In this case, if the lower limit voltage is 2V and the upper limit voltage is 3V, the output of the switch controller 130 becomes 2.5V, as evident from Equation 1.

It is noted that the connections of the internal switches (not shown) on the basis of the input data as described above are not limited in any sense to the above embodiment and may be varied as needed.

The analog signals outputted through the plurality of output lines of the switch controller 130 are received by the amplifier 140. The amplifier 140 performs interpolation with respect to the input analog signals, and after amplifying a result, outputs a final, predetermined gradation voltage $V_{OUT}$ through its output terminal.

The current decoder 150 receives input of data of the lowermost j bits in the input data of k bits, and according to the j bits, selects specific switching means NM of the constant current means 155*a*~155*n* and outputs a predetermined current to the ground terminal VSS from the current outputted by the amplifier 140.

For example, if the lowermost j bits inputted to the current decoder 150 are 2 bits, the current decoder 150 is structured including j constant current means (i.e., the two constant current means 155*a*, 155*b*), and not $2^j$ (4 in this case) constant current means. If, in this case, the data inputted to each of the switching means NM is 0, each of the switching means NM of the first and second constant current means 155*a*, 155*b* is turned off, and at the same time, the current decoder 150 turns on the buffer switch SW1 which is connected in parallel with the feedback resistor Rf1.

Further, in the case where the data inputted to the switching means NM of the constant current means 155*a*, 155*b* are respectively 0 and 1 (D[10]), the switching means NM of the first constant current means 155*a* is turned off and the switching means NM of the second constant current means 155*b* is turned on, and at the same time, the buffer switch SW1 is turned off by the current decoder 150. In the case where the data inputted to each of the switching means NM of the constant current means 155*a*, 155*b* is 1, the switching means NM of the first and second constant current means 155*a*, 155*b* are both turned on, and at the same time, the buffer switch SW1 is turned off by the current decoder 150.

Moreover, if the data inputted to the switching means NM of the constant current means 155*a*, 155*b*, 155*c* are respectively 0, 1, and 1 (D[101]), the switching means NM of the first constant current means 155*a* is turned on, the switching means NM of the second constant current means 155*b* is turned off, and the switching means NM of the third constant current means 155*c* is turned on, and at the same time, the buffer switch SW1 is turned off by the current decoder 150. In this case, each of the constant current means 155*a*, 155*b*, and 155*c* applies a current amount to the ground terminal VSS corresponding to $I_{REF}$ (reference current) times 2 to the power of the binary number bit number of the input data for the particular constant current means 155*a*, 155*b*, 155*c*.

Table 1 below lists the on/off states of the switching means NM of the first, second, and third constant current means 155*a*, 155*b*, 155*c*, as well as of the buffer switch SW1 when the lower bits inputted to the current decoder 150 are data of 3 bits.

TABLE 1

Data of 3 bits inputted to current decoder

| INPUT DATA | FIRST CONSTANT CURRENT MEANS | SECOND CONSTANT CURRENT MEANS | THIRD CONSTANT CURRENT MEANS | BUFFER SWITCH |
|---|---|---|---|---|
| 000 | OFF | OFF | OFF | ON |
| 001 | ON | OFF | OFF | OFF |
| 010 | OFF | ON | OFF | OFF |
| 011 | ON | ON | OFF | OFF |
| 100 | OFF | OFF | ON | OFF |
| 101 | ON | OFF | ON | OFF |
| 110 | OFF | ON | ON | OFF |
| 111 | ON | ON | ON | OFF |

Through the combined operation of the constant current means 155*a*, 155*b*, 155*c* according to the input data, as shown in Table 1, the number of the constant current means may be minimized. This is due to the fact that the constant current amounts established for the constant current means 155*a*, 155*b*, 155*c* are different. Hence, even with an increase in resolution, the size of the DAC 100 may be reduced.

That is, with reference FIG. 3, if the current established by the constant current unit 155 according to the data (D<j:1>1) inputted to the current decoder 150 flows from the output terminal of the amplifier 140 to the ground terminal VSS through the feedback resistor Rf1, the inverting input terminal (−) of the amplifier 140 generates a corresponding voltage reduction. Next, the amplifier 140 compares the voltages inputted to the non-inverting input terminals (+) and the inverting input terminal (−), and performs compensation by an amount of the reduced voltage. Accordingly, the voltage $V_{OUT}$ of the output terminal of the amplifier 140 is varied according to the amount of current flowing through the current decoder 150, such that the voltage is linearly divided to express grayscale.

Figure 5:
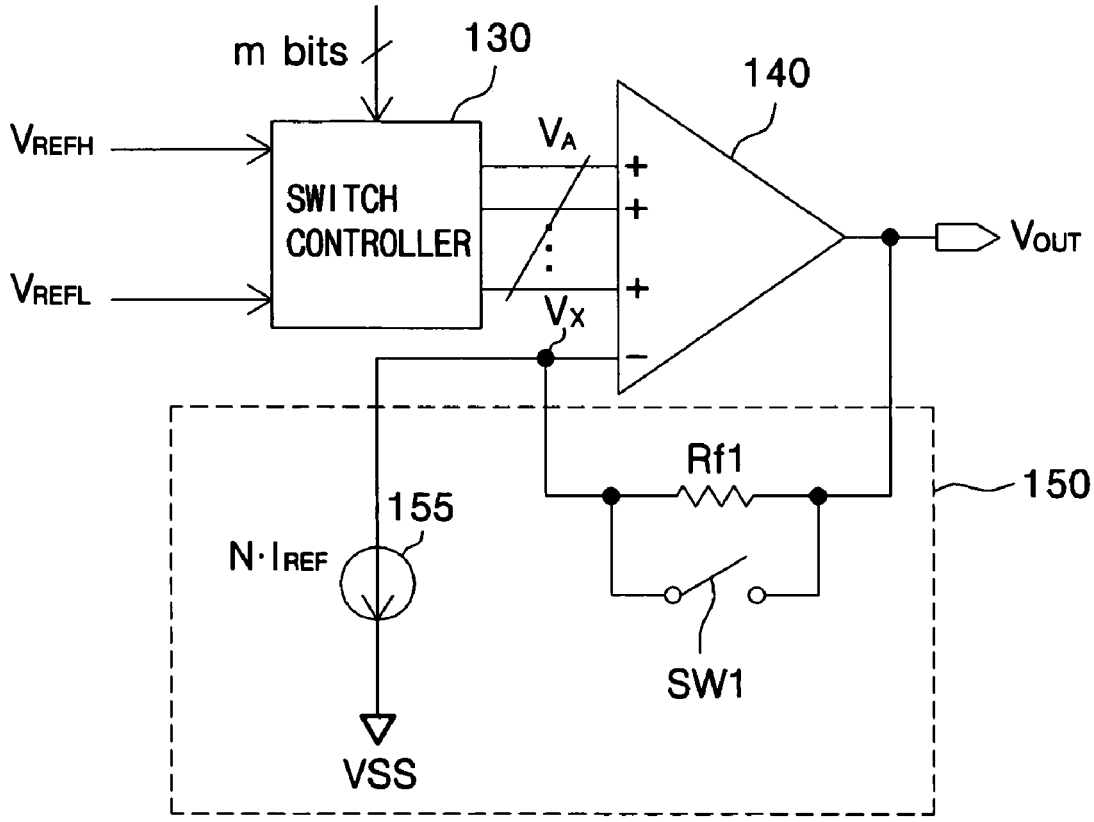
FIG. 5 is a simplified schematic circuit diagram of the digital-to-analog converter of FIG. 3.

FIG. 5 is a simplified schematic circuit diagram of the digital-to-analog converter 100 of FIG. 3. An example is given by which the lower bits inputted to the current decoder 150 are 3 bits.

If $V_A$ is the voltage inputted to the amplifier 140, the output voltage $V_{OUT}$ of the amplifier 140 is as shown in Equation 2 below.

[Equation 2]

$$A_V(V_A-V_X)=V_{OUT} \quad ①$$

$$V_{OUT}-V_X=Rf1\cdot N\cdot I_{REF} \quad ②$$

where, $V_{OUT}$ is a final output voltage of an amplifier, $V_A$ is an input voltage of the amplifier, $A_V$ is a gain of the amplifier, Rf1 is a feedback resistance value of the amplifier, $V_X$ is a voltage applied to an inverting input terminal of the amplifier, N is a decimal value, and $I_{REF}$ is a current value flowing through constant current source.

In Equation 2, by substituting Equation ② into $V_X$ of Equation ①, Equation 3 as shown below is obtained.

$$V_{OUT} = \frac{A_V}{1 + A_V}(V_A - Rf1 \cdot N \cdot I_{REF}) \simeq V_A + Rf1 \cdot N \cdot I_{REF} \quad \text{[Equation 3]}$$

As is evident from Equation 3, the current established in the constant current unit 155 in accordance with the voltage $V_A$ inputted to the amplifier 140 and the data (D<j:1>) inputted to the constant current unit 155 of the current decoder 150 flows from the output terminal of the amplifier 140 to the ground terminal VSS via the feedback resistor Rf1. As a result, a voltage reduction $V_X$ occurs at the inverting input terminal (−) of the amplifier 140 due to the feedback resistor Rf1. The amplifier 140 then compares the voltages inputted to the non-inverting input terminals (+) and the inverting input terminal (−) and performs compensation by an amount equal to the reduction in voltage. Accordingly, by adding to the input voltage $V_A$ a voltage (Rf1*N. $I_{REF}$) corresponding to the current flowing to the ground terminal VSS through the current decoder 150, the amplifier 140 linearly outputs a voltage.

The different output voltages $V_{OUT}$ of the amplifier 140 according to the input data in the case where the data inputted to the current decoder 150 is 3 bits are shown in Table 2 below.

TABLE 2

| INPUT DATA | $V_{OUT}$ |
|---|---|
| 000 | $V_A + 0$ |
| 001 | $V_A + 1I_{REF} \cdot Rf1$ |
| 010 | $V_A + 2I_{REF} \cdot Rf1$ |
| 011 | $V_A + 3I_{REF} \cdot Rf1$ |
| 100 | $V_A + 4I_{REF} \cdot Rf1$ |
| 101 | $V_A + 5I_{REF} \cdot Rf1$ |
| 110 | $V_A + 6I_{REF} \cdot Rf1$ |
| 111 | $V_A + 7I_{REF} \cdot Rf1$ |

As shown in Table 2, if the data (D<j:1>) inputted to the current decoder 150 is "000," all the switching means NM of the constant current means 155*a*~155*n* are turned off, such that the output voltage $V_{OUT}$ of the amplifier 140 is not applied to the ground terminal VSS. In this case, it is preferable that the buffer switch SW1 connected in parallel with the feedback resistor Rf1 is turned on, such that the output voltage $V_{OUT}$ of the amplifier 140 is equal to the input voltage $V_A$ of the amplifier 140 without undergoing any reduction due to the feedback resistor Rf1.

Figure 6:
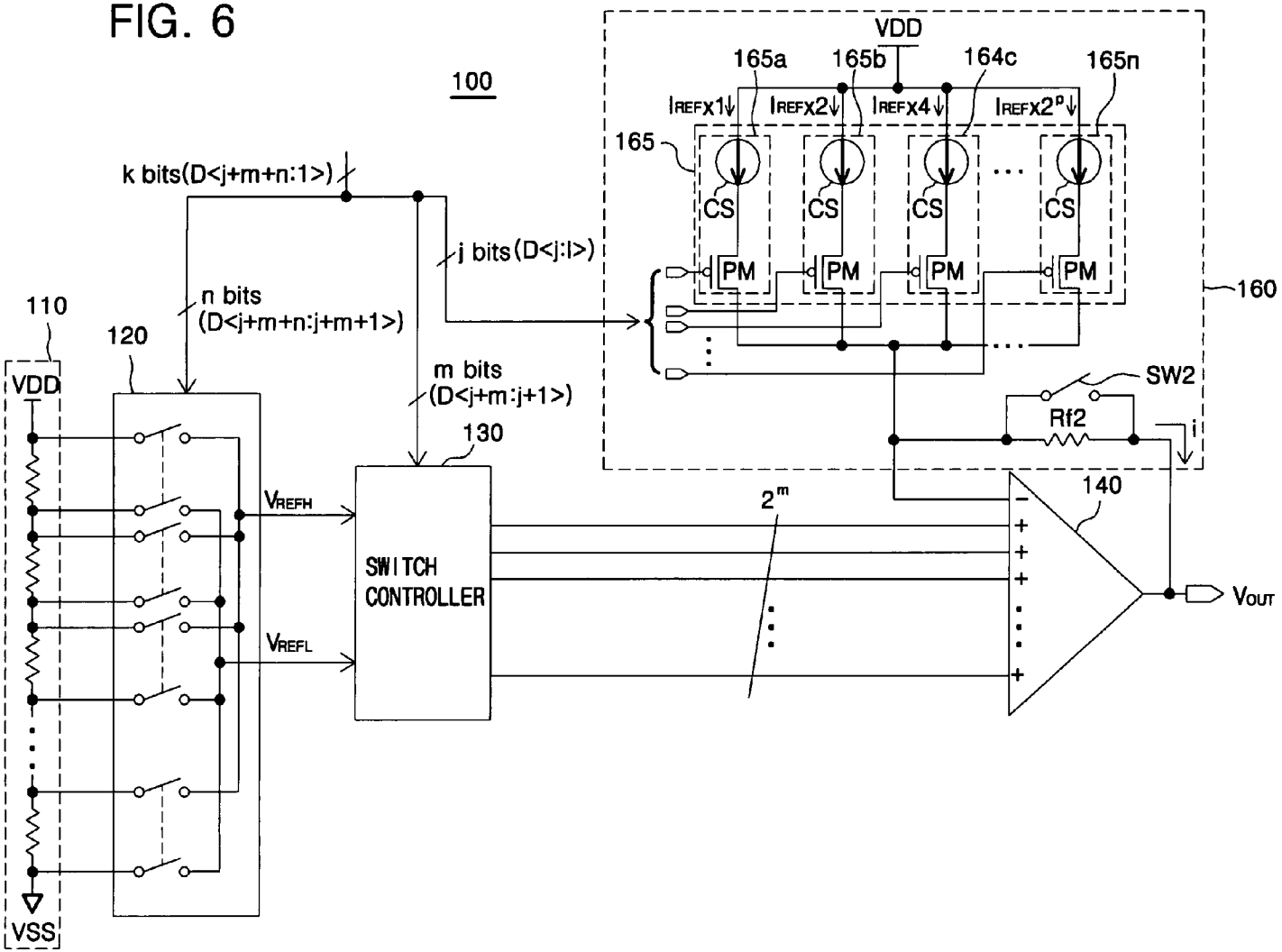
FIG. 6 is a schematic circuit block diagram of a digital-to-analog converter for a display device according to another embodiment of the present invention.

FIG. 6 is a schematic circuit block diagram of a DAC 100 for a display device according to another embodiment of the present invention. The DAC 100 includes a gradation voltage generator 110, a decoder 120, a switch controller 130, an amplifier 140, and a current decoder 160.

The gradation voltage generator 110, the decoder 120, the switch controller 130, and the amplifier 140 are identical in structure to the same elements of the DAC 100 shown in FIG. 3. However, the structure of the current decoder 160 is different to the same element of the DAC 100 shown in FIG. 3.

Accordingly, a detailed description of the gradation voltage generator 110, the decoder 120, the switch controller 130, and the amplifier 140 will be omitted herein, and only the current decoder 160 will be described in detail below.

In particular, the current decoder 160 operates according to the input values of the lowermost j bits in the input data of k bits, such that a supply voltage is applied to the output terminal of the amplifier 140 by a predetermined current amount through the feedback loop of the amplifier 140.

The current decoder 160 includes a feedback resistor Rf2, a buffer switch SW2, and a constant current unit 165.

The feedback resistor Rf2 is disposed on a feedback current path from the output terminal of the amplifier 140 to the inverting input terminal (−) of the amplifier 140. The buffer switch SW2 is connected in parallel with the feedback resistor Rf2.

The constant current unit 165 is connected in series between one terminal of the feedback resistor Rf2 and a source terminal VDD, and undergoes switching according the input data of the lower bits to thereby apply a predetermined current to the output terminal of the amplifier 140.

The constant current unit 165 preferably includes a number of constant current means that is equal to the number of bits of the lowermost bits. In the case where the constant current unit 165 includes a plurality of constant current means 165*a*~165*n*, the constant current means 165*a*~165*n* are connected in parallel between one terminal of the feedback resistor Rf2 and the ground terminal VSS, and operate depending on the input of different bit positions of data.

In this case, the amount of current applied to the output terminal of the amplifier 140 is different for each of the constant current means 165*a*~165*n*.

Moreover, each of the constant current means 165*a*~165*n* includes a switching means PM and a constant current source CS. The switching means PM of each of the constant current means 165*a*~165*n* is connected in series with the current path between the one terminal of the feedback resistor Rf2 and constant current source CS, and undergoes switching while receiving as input a particular bit among the lowermost bits. The constant current source CS of each of the constant current means 165*a*~165*n* is connected in series between one terminal of the corresponding switching means PM and the source terminal VDD, and applies a predetermined current to the output terminal of the amplifier 140 according to the switching state of the corresponding switching means PM.

The switching means PM of each of the constant current means 165*a*~165*n* undergoes switching while receiving as input a particular bit among the lowermost j bits, and is a PMOS transistor in this embodiment.

In the case where the constant current unit 165 includes a plurality of constant current means 165*a*~165*n*, the constant current source CS of each of the constant current means 165*a*~165*n* applies a current amount to the output terminal of the amplifier corresponding to $I_{REF}$ (reference current) times 2 to the power of the binary number bit number of the input data for the particular constant current means. That is, each of the constant current means 165*a*~165*n* applies to the output terminal of the amplifier a current amount of $I_{REF} \times 2^p$ (where p is the binary number bit number of the input data for the particular constant current means and which is used as the exponential value applied to the base 2).

In the above, the buffer switch SW2 connected in parallel with the feedback resistor Rf2 is turned on when the values of the lowermost j bits are all "0."

Figure 7:
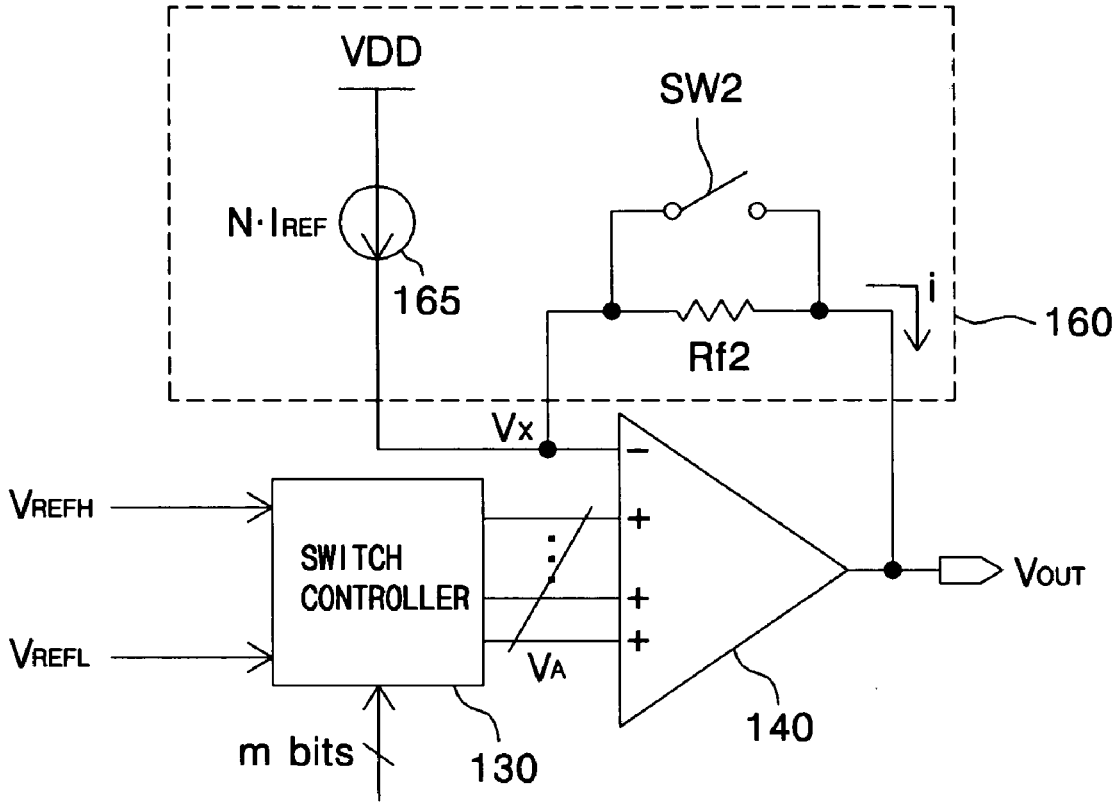
FIG. 7 is a simplified schematic circuit diagram of the digital-to-analog converter of FIG. 6.

FIG. 7 is a simplified schematic circuit diagram of the DAC 100 of FIG. 6. The circuit may be analyzed in the same manner as the circuit of FIG. 5.

In FIG. 7, if $V_A$ is the voltage inputted to the amplifier 140, the output voltage $V_{OUT}$ of the amplifier 140 is linearly reduced according the predetermined current applied to the output terminal of the amplifier 140 from the current decoder 160 through the feedback resistor Rf2. This may be expressed as Equations 4 and 5 below.

[Equation 4]

$$A_V(V_A - V_X) = V_{OUT} \quad ③$$

$$V_X - V_{OUT} = Rf2 \cdot N \cdot I_{REF} \quad ④$$

where, $V_{OUT}$ is a final output voltage of an amplifier, $V_A$ is an input voltage of the amplifier, $A_V$ is a gain of the amplifier, Rf2 is a feedback resistance value of the amplifier, $V_X$ is a voltage applied to an inverting input terminal of the amplifier, N is a decimal value, and $I_{REF}$ is a current value flowing through constant current source.

In Equation 4, by substituting Equation ③ into $V_X$ of Equation ④, Equation 5 as shown below is obtained.

[Equation 5]

$$V_{OUT} = \frac{A_V}{1 + A_V}(V_A - Rf2 \cdot N \cdot I_{REF}) \simeq V_A - Rf2 \cdot N \cdot I_{REF}$$

As is evident from Equation 5, the current established in the constant current unit 165 in accordance with the voltage $V_A$ inputted to the amplifier 140 and the data (D<j:1>) inputted to the constant current unit 165 of the current decoder 160 flows to the output terminal of the amplifier 140 via the feedback resistor Rf2. As a result, due to the feedback resistor Rf2, the voltage of the inverting input terminal (−) of the amplifier 140 is higher than the voltage $V_{OUT}$ of the output terminal of the amplifier 140, after which the amplifier 140 compares the voltages inputted to the non-inverting input terminal (+) and the inverting input terminal (−) and performs compensation by an amount of the increase in voltage. Accordingly, by subtracting a voltage (Rf2*N. $I_{REF}$) corresponding to the current flowing to the output terminal of the amplifier 140 through the current decoder 150 from the input voltage $V_A$, the amplifier 140 linearly outputs a voltage.

The different output voltages $V_{OUT}$ of the amplifier 140 according to the input data in the case where the data inputted to the current decoder 160 is 3 bits are shown in Table 3 below.

TABLE 3

| INPUT DATA | $V_{OUT}$ |
|---|---|
| 000 | $V_A - 0$ |
| 001 | $V_A - 1I_{REF}$ . Rf2 |
| 010 | $V_A - 2I_{REF}$ . Rf2 |
| 011 | $V_A - 3I_{REF}$ . Rf2 |
| 100 | $V_A - 4I_{REF}$ . Rf2 |
| 101 | $V_A - 5I_{REF}$ . Rf2 |
| 110 | $V_A - 6I_{REF}$ . Rf2 |
| 111 | $V_A - 7I_{REF}$ . Rf2 |

As shown in Table 3, if the data (D<j:1>) inputted to the current decoder 160 is "000," all the switching means PM of the constant current means 165*a*~165*n* are turned off, such that the supply voltage is not applied to the output terminal of the amplifier 140. In this case, it is preferable that the buffer switch SW2 connected in parallel with the feedback resistor Rf2 is turned on, such that the output voltage $V_{OUT}$ of the amplifier 140 is not reduced by the feedback resistor Rf1.

Hence, in the present invention, interpolation is performed in the switch controller 130 with respect to the lower m bits to thereby determine a gradation voltage as in conventional configurations. With respect to the lowermost j bits, the current decoder 160 is used to adjust the current outputted by the amplifier 140 to thereby determine an analog gradation voltage.

In particular, current is adjusted with respect to the lowermost j bits such that the voltage outputted by the amplifier 140 is varied, thereby ultimately outputting a desired analog value.

In the present invention, through use of a combination of a voltage division method and a current adjusting method to convert input data into an analog signal, the size of the decoder portion is reduced. Moreover, through use of the current adjusting method, a high grayscale may be expressed even with a small amount of current, such that a high-resolution image is easily realized.

In the embodiments of the present invention, the DAC was described as being linearly used. However, in alternative embodiments, each resistor value of the gradation voltage generator may be non-linearly designed or the constant current of the current decoder may be non-linearly designed, such that the DAC is non-linearly used.

In addition, although the DAC of the present invention is described as being applied to a digital display device, the DAC of the present invention is not limited in this respect and may be applied to a variety of different technologies, as may be contemplated by those skilled in the art.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to an exemplary embodiment, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A digital-to-analog converter (DAC) for a display device, the DAC comprising:

an amplifier which receives a gradation voltage with respect to upper bits in data of k bits through a non-inverting input terminal, and which varies the input gradation voltage according to a voltage applied to an inverting input terminal; and a current decoder which allows a predetermined constant current to flow therethrough according to input data of lower bits excluding the upper bits to vary the voltage applied to the inverting input terminal, and which adjusts the gradation voltage outputted by the amplifier according to the varied voltage, wherein the current decoder comprises:

a feedback resistor which is disposed on a feedback current path from an output terminal of the amplifier to the inverting input terminal of the amplifier;

a constant current unit which is connected in series between one terminal of the feedback resistor and a ground terminal, and which undergoes switching according to the input data of the lower bits to flow a predetermined fixed current to the ground terminal, and a buffer switch connected in parallel with the feedback resistor.

2. The DAC of claim 1, wherein the current decoder adjusts the gradation voltage outputted by the amplifier in accordance with the application of a predetermined current to a ground terminal, the level of the predetermined current being determined on the basis of the input data of the lower bits.

3. The DAC of claim 1, wherein:

the constant current unit comprises a number of constant current means corresponding to the number of the lower bits; and the constant current means are mounted in parallel between the one terminal of the feedback resistor and the ground terminal.

4. The DAC of claim 3, wherein each of the constant current means comprises a switching means and a constant current source, the switching means being connected in series on a current path between the one terminal of the feedback resistor and the constant current source and undergoing switching while receiving as input the data of a particular bit among the lower bits, the constant current source being connected in series between one terminal of the switching means and the ground terminal and applying a fixed current outputted by the amplifier to the ground terminal according to the switching state of the switching means.

5. The DAC of claim 4, wherein each of the constant current means applies a current amount to the ground terminal corresponding to $I_{REF}$ (reference current) times 2 to the power of the binary number bit number of the input data for the particular constant current means.

6. The DAC of claim 4, wherein each of the switching means is an NMOS transistor.

7. The DAC of claim 1, wherein the buffer switch is turned on when the data of the lower bits are all "0."

8. The DAC of claim 1, wherein the current decoder adjusts the gradation voltage outputted by the amplifier in accordance with the application of a predetermined current to an output terminal of the amplifier, the level of the predetermined current being determined on the basis of the input data of the lower bits.

9. The DAC of claim 8, wherein the current decoder comprises:

a feedback resistor which is disposed on a feedback current path from the output terminal of the amplifier to the inverting input terminal of the amplifier; and a constant current unit which is connected in series between one terminal of the feedback resistor and a source terminal, and which undergoes switching according to the input data of the lower bits to apply a predetermined fixed current to the output terminal of the amplifier.

10. The DAC of claim 9, wherein:

the constant current unit comprises a number of constant current means corresponding to the number of the lower bits; and the constant current means are mounted in parallel between the one terminal of the feedback resistor and the source terminal.

11. The DAC of claim 10, wherein each of the constant current means receives a different bit of the lower bits.

12. The DAC of claim 10, wherein each of the constant current means applies a current amount to the output terminal of the amplifier corresponding to $I_{REF}$ (reference current) times 2 to the power of the binary number bit number of the input data for the particular constant current means.

13. The DAC of claim 10, wherein each of the constant current means comprises a switching means and a constant current source, the switching means being connected in series on a current path between the one terminal of the feedback resistor and the constant current source and undergoing switching while receiving as input the data of a particular bit among the lower bits, the constant current source being connected in series between one terminal of the switching means and the source terminal and applying a source voltage according to the switching state of the switching means.

14. The DAC of claim 13, wherein each of the switching means is a PMOS transistor.

15. The DAC of claim 9, wherein the buffer switch being turned on when the data of each of the lower bits is "0."

16. A digital-to-analog converter (DAC) for a display device, the DAC comprising:

a decoder which receives data of n bits in input data of k bits, the decoder outputting a plurality of gradation voltages corresponding to the n bits to each of a plurality of reference lines;

a switch controller which controls a plurality of internal switches according to input data of m bits in the input data of k bits to multiplex the gradation voltages inputted through the plurality of reference lines;

an amplifier which receives through a non-inverting input terminal thereof a plurality of gradation voltages outputted by the switch controller, and after performing interpolation, varies a resulting voltage according to a voltage applied to an inverting input terminal of the amplifier to obtain and output a gradation voltage; and a current decoder which allows a predetermined constant current to flow therethrough according to input data of lowermost j bits in the input data of k bits to vary the voltage applied to the inverting input terminal, and which adjusts the gradation voltage outputted by the amplifier according to the varied voltage, wherein the current decoder comprises:

a feedback resistor which is disposed on a feedback current path from an output terminal of the amplifier to the inverting input terminal of the amplifier;

a constant current unit which is connected in series between one terminal of the feedback resistor and a ground terminal, and which undergoes switching according to the input data of the lower bits to flow a predetermined fixed current to the ground terminal, and a buffer switch connected in parallel with the feedback resistor.

17. The DAC of claim 16, wherein the current decoder adjusts the gradation voltage outputted by the amplifier in accordance with the application of a predetermined current to a ground terminal, the level of the predetermined current being determined on the basis of the input data of the lowermost j bits.

18. The DAC of claim 16, wherein:

the constant current unit comprises a number of constant current means corresponding to the number of the lower bits; and the constant current means are mounted in parallel between the one terminal of the feedback resistor and the ground terminal, if there is a plurality of the constant current means.

19. The DAC of claim 17, wherein each of the constant current means comprises a switching means and a constant current source, the switching means being connected in series on a current path between the one terminal of the feedback resistor and the constant current source and undergoing switching while receiving as input the data of a particular bit among the lowermost j bits, the constant current source being connected in series between one terminal of the switching means and the ground terminal and applying a fixed current outputted by the amplifier to the ground terminal according to the switching state of the switching means.

20. The DAC of claim 16, wherein the current decoder adjusts the gradation voltage outputted by the amplifier in accordance with the application of a predetermined current to an output terminal of the amplifier, the level of the predetermined current being determined on the basis of the input data of the lower bits.

* * * * *